US006655392B2

(12) United States Patent
Erwin et al.

(10) Patent No.: US 6,655,392 B2
(45) Date of Patent: Dec. 2, 2003

(54) METHOD AND APPARATUS FOR CLEANING A FUEL INJECTED ENGINE PLENUM

(75) Inventors: Harold E. Erwin, Augusta, KS (US); Ronald R. Leslie, Golden, CO (US)

(73) Assignee: BG Products, Inc., Wichita, KS (US)

( * ) Notice: Subject to any disclaimer, the term of this patent is extended or adjusted under 35 U.S.C. 154(b) by 167 days.

(21) Appl. No.: 10/045,218

(22) Filed: Nov. 7, 2001

(65) Prior Publication Data

US 2003/0084924 A1 May 8, 2003

(51) Int. Cl.[7] ..... B08B 3/08; B08B 9/00

(52) U.S. Cl. ..... 134/22.1; 134/22.18; 134/22.19; 123/1 A; 123/198 A

(58) Field of Search ..... 134/22.1, 22.12, 134/22.16, 22.17, 22.18, 22.19, 38, 40, 42; 123/198 A, 1 A

(56) References Cited

U.S. PATENT DOCUMENTS 4,989,561 A 2/1991 Hein et al.
5,232,513 A 8/1993 Suratt et al.
5,485,857 A 1/1996 Amundsen
5,503,683 A 4/1996 Butcher et al.
5,692,461 A 12/1997 Crovato et al.
5,826,602 A 10/1998 Chen
5,970,994 A 10/1999 Sasaki et al.
6,478,036 B1 * 11/2002 Connors et al. ..... 134/102.2

OTHER PUBLICATIONS

1996 Parts Catalog of BG Products, Inc.—Part No. 97897.

* cited by examiner

*Primary Examiner*—Randy Gulakowski
*Assistant Examiner*—Saeed Chaudhry
(74) *Attorney, Agent, or Firm*—Shook, Hardy & Bacon L.L.P.

(57) ABSTRACT

A method and apparatus for cleaning the plenum of a vehicle are disclosed. The apparatus includes an introduction device that is removably attachable to the manifold of an engine in the location of the IAC port. The introduction device atomizes a flow of cleaning solvent and introduces the atomized flow into the plenum at the IAC port.

5 Claims, 3 Drawing Sheets

METHOD AND APPARATUS FOR CLEANING A FUEL INJECTED ENGINE PLENUM

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

This invention relates to the maintenance of automobile internal combustion engines and, more particularly, to a method and apparatus for cleaning a fuel injected engine plenum through the idle air control port.

In order for automobile engines to function efficiently, it is important that sludge, varnish and other unwanted elements are not allowed to accumulate on the surfaces of the air intake assembly (or plenum). In carbureted and throttle body engines, nearly all areas of the air intake assembly except for the filter itself are constantly in contact with a supply of fog or fuel spray. The throttle plate of the air intake assembly is even sprayed as fuel proceeds to the intake valves and combustion chamber. This spray tends to keep the plenum relatively free from buildup.

However, in port fuel injected engines, fuel is sprayed in close proximity with the intake valves, and is not in a foggy state when it enters the plenum of the air intake assembly. As a result, sludge and varnish tend to coat the inside of the manifold over time. When the engine is shut off, vapors from the combustion chamber rise into the plenum through those intake valves that are either completely open or partially open. Since the plenum is significantly cooler than the crankcase, the vapors condense to form large oil deposits. Also, in many engines, the Exhaust Gas Recirculation System (EGR) dumps particle laden exhaust gas directly into the mouth of the plenum, and hard carbon deposits form within the plenum. The exhaust deposits are concentrated about the port or ports where the particle laden gas enters the plenum.

The vapors cool and condense into particles that collect on the walls of the plenum. The particles include moisture, fuel, oil and exhaust carbon deposits. A thick sludge collects on the flat base of the plenum and the other horizontal surfaces within the plenum. Deposits also form on the walls of the plenum in the form of varnish deposits that are particularly difficult to remove. Additionally, since the throttle plate (or throttle plates) are closed when the engine is shut off, the backside of each plate is coated with harmful deposits of the particles. In addition to these surfaces, the mass air flow sensor, mass air pressure sensor and other sensors become coated with the deposits.

Initially, the designers of port fuel injected engines believed that buildup of deposits would not create a problem due to the substantial size of the plenums in these type of engines. As a result, no provisions were made to allow the plenum to be easily accessible for occasional cleaning. However, the size of the plenum has not prevented the adverse effects of plenum buildup.

The negative consequences of unwanted accumulations of sludge and other contaminants are numerous and severe. For example, the presence of deposits throughout the plenum requires that more air be supplied to idle the engine at the appropriate speed. Briefly, most engines have an Idle Air Control (IAC) System to control the precise amount of air required for the engine to idle at the proper RPM. The IAC System increases or decreases the idle speed under varying load condition to prevent stalling of the engine. The IAC System includes an IAC valve that is positioned in communication with a conduit that bypasses the throttle plate. The IAC valve is mounted at an IAC port disposed along the bypass conduit. The IAC valve is typically a motorized pintle valve having a tapered valve tip that extends or retracts relative to a seat formed in the bypass conduit near the IAC port. When the valve tip is close to the seat, little air is allow around the throttle plate and ultimately into the combustion chamber. When the valve tip is retracted from the seat, more air is allowed around the throttle plate. An IAC sensor located in the plenum sends information to an electronic control module (ECM) that controls the position of the tapered tip of the IAC valve to regulate the volume of air provided to the plenum. The IAC sensor measures the amount of air required to idle the engine at a certain RPM compared to the amount of air required when the vehicle was new. As deposits accumulate within the plenum, more air is required to idle the engine, and the ECM automatically adds more fuel to create a rich condition. This condition leads to poor driving performance, higher emissions and lower fuel economy.

Other engine problems are attributable to a dirty plenum. For example, when deposits accumulate on the various sensors disposed within the plenum, the operation of the vehicle's computers is disrupted since the input information received from the sensors is no longer accurate. Namely, the ECM takes readings from the sensors to control the fuel to air ratio and EGR system. When the sensors are covered with deposits, the engine will operate inefficiently to cause additional performance and emissions problems.

Many attempts have been made to clean the plenums in port fuel injected engines. One method is to coat the inside of the plenum with a special chemical coating. However, these coatings have not proven effective-particularly with recent reformulations of fuel. Another method involves spraying an aerosol cleaning solution at or near the throttle plate. In order for the aerosol spray to reach the depths of the plenum, the aerosol must be sprayed while the engine is running. However, when aerosol is sprayed while the vehicle is running, the vehicle runs at much higher speeds than normal, and numerous problems may ensue. For instance, a vortex sometimes forms near the center of the plenum that pulls the aerosol away from the surfaces of the plenum that require cleaning. Also, when the engine is operating at a high speed, the dry solvent will strip the normal lubricating oil film from the walls of the cylinder, and scoring may occur. Also, aerosols are often difficult to meter properly. Too little aerosol leads to ineffective cleaning, and too much aerosol leads to hydrolocking of the engine since the engine's combustion chamber is not capable of compressing the liquid. The potential for hydrolocking makes it particularly difficult to spray behind the throttle plate with the engine running. Another practical problem is the possibility that the straw secured to the aerosol may be dislodged and drawn into the combustion chamber.

Another method of cleaning the plenum utilizes an atomizing apparatus that creates a fog of cleaner at the front of the throttle plate. The cleansing fog must go around the throttle plate to enter the plenum. However, the throttle plate is completely closed at times when the engine idles and must be opened to allow cleaner to flow into the plenum. When the throttle is opened, the vortex effect may occur and limit the effectiveness of the cleaner. Also, most of these atomizing systems require that the flexible boot between the air filter box and plenum mouth be removed. If the vehicle's computer relies upon a sensor in the boot, removal of the boot may cause the computer codes to be tripped and/or the engine to stop running.

In another method, a cleaning system having its own throttle control is connected to the mouth of the plenum. In these systems, if the cleaning fog is pulled through the IAC conduit and contacts the components of the IAC, serious damage may occur. Also, for many vehicles, the mass air flow sensor is located near the mouth of the plenum instead of the hose connecting the air filter box and the plenum. In these vehicles, the sensor can not be removed to accommodate this cleaning method since the vehicle will not run when the sensor is removed.

One other method involves removal of a plenum vacuum hose and insertion of a small metering tip. When the engine is started, the vacuum formed inside of the plenum draws cleaner from the metering tip. While the problems associated with the engine running at high speeds are generally avoided, the danger of hydrolocking is great with this method. Specifically, since the only vacuum port available may be located over a branch in the plenum that goes to a single cylinder, too much aerosol may be provided to the cylinder. In addition to the problem of hydrolocking, the brake system of the vehicle may be compromised when the power brake booster line is selected as the vacuum port within which the metering tip is placed. In addition to these problems, the metering tip does not atomize the cleanser effectively, and the degree of cleaning that occurs is not satisfactory. Attempts to introduce cleaning solvents through the IAC port have failed to control the flow of air and cleaner into the plenum, and effective and safe cleaning of the plenum has not been achieved.

SUMMARY OF THE INVENTION

It is therefore an objective of the present invention to provide a method and apparatus for cleaning the plenum of a port fuel injected engine that is effective, but simple and inexpensive to perform.

It is an overall object of the present invention to provide a system for cleaning the plenum of a port fuel injected engine that overcomes the deficiencies of other methods currently used in the art.

To accomplish these and other related objects, a method and apparatus for cleaning the plenum through the IAC port is disclosed. A method and apparatus for cleaning the plenum of a vehicle are disclosed. The apparatus includes an introduction device that is removably attachable to the manifold of an engine in the location of the IAC port. The introduction device atomizes a flow of cleaning solvent and introduces the atomized flow into the plenum at the IAC port. The apparatus controls the rate of flow of air into the plenum while the atomized flow is introduced.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENT

Figure 1:
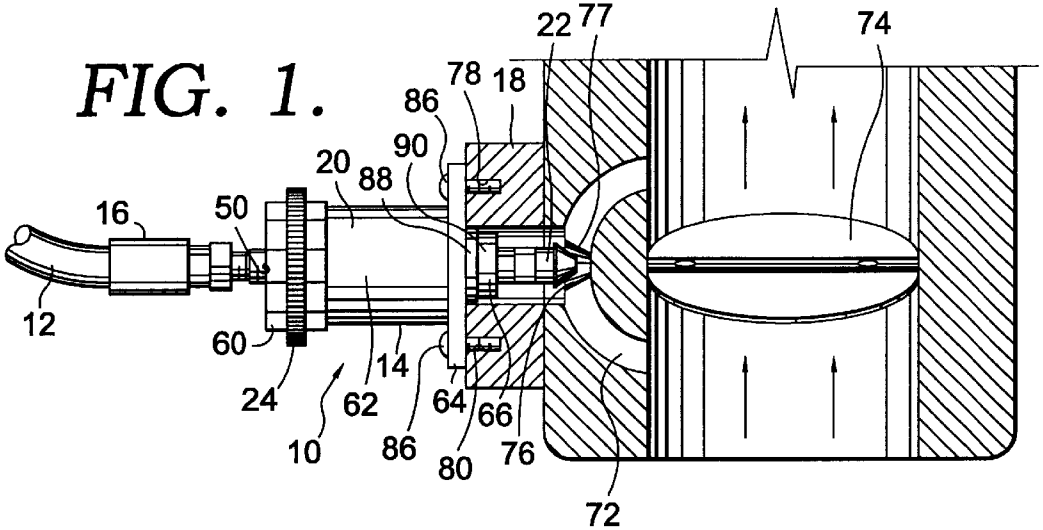
FIG. 1 is a side elevational view of one embodiment of the present invention, shown coupled to the IAC mounting block of a vehicle, with parts of the vehicle shown in section.

An apparatus for cleaning the plenum of a port fuel injected combustion engine is broadly designated in the drawings by the reference numeral 10. With initial reference to FIG. 1, apparatus 10 includes a supply tank (not shown), a supply hose 12, and a cleaner introduction device 14.

The introduction device 14 is supplied with cleaning solvent from the supply tank via the supply hose 12. Hose 12 is connected to the supply tank at one end and is connected to the introduction device 14 at the other end at a fitting 16 secured to the end of the hose. The supply hose is preferably made of flexible rubber material, and the fitting is made of a light metal such as brass or aluminum. The cleaning solvent is preferably gravity fed from the tank. By gravity feeding the cleaning solvent, the problems associated with the introduction of too much cleaning solvent into the engine are avoided, and the risk of hydrolocking is minimized.

The preferred solvent of the present invention is a solvent offered by BG Products, Inc. and sold under the name BG Air Intake System Cleaner P/N 206. The composition of the solvent is readily ascertainable from the label of the product. While this BG P/N 206 solvent is the preferred solvent of the system, it is to be understood that other solvents capable of dissolving sludge and carbon deposits may also be used and are within the scope of the present invention.

Figure 2:
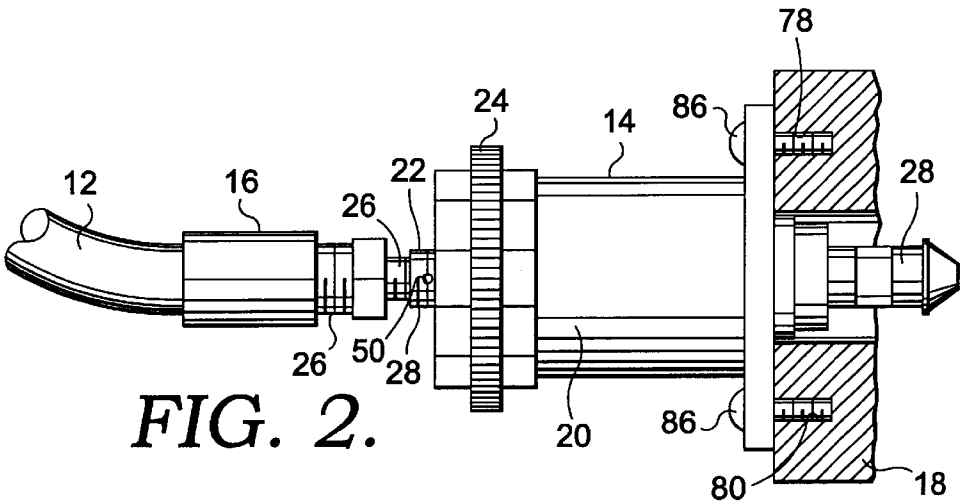
FIG. 2 is an enlarged fragmentary, elevational view of the embodiment of FIG. 1 with the pintle head in an extended position, and the IAC mounting block shown in section.
Figure 4:
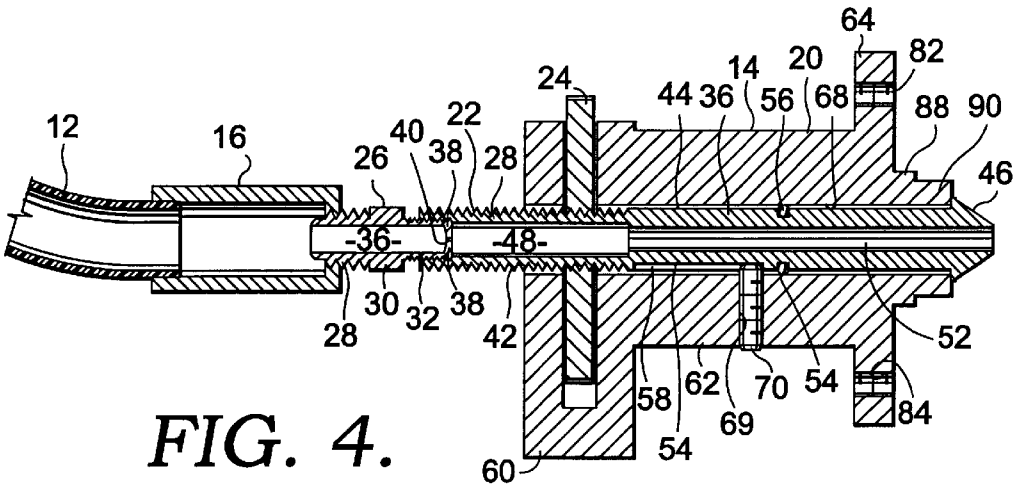
FIG. 4 is a sectional view taken along line 4—4 of FIG. 3.

The introduction device 14 is coupled with the manifold of the vehicle at the IAC mounting block 18. As best shown in FIGS. 2 and 4, introduction device 14 includes a housing 20, a pintle 22 moveable relative to the housing and a screw adjuster 24 for controlling the position of the pintle. In the preferred embodiment, the pintle 22 includes a threaded inlet 26 and a pintle body 28. With reference to FIG. 4, the threaded inlet 26 has a first threaded cylindrical portion 28 onto which the fitting 16 is secured, an integral nut 30 and a second threaded cylindrical portion 32 received within the pintle body 28. The integral nut 30 is used to secure the second cylindrical portion within the pintle body. A first chamber 36 is defined lengthwise within the inlet 26 and terminates at an deflector plate 38. A venturi orifice 40 having preferably having a diameter of 0.025 inches is located centrally through the plate 28 to place the chamber 36 in communication with the interior of pintle body 28.

The pintle body 28 includes a first threaded cylindrical segment 42, an extension 44 and a tapered pintle head 46. First segment 42 is internally threaded at a first end to receive the second cylindrical portion of threaded inlet 26, and defines a chamber 48 in communication with the chamber 36 via the aperture 40. Preferably, the diameter of each chambers 36 and 48 is about one-fourth of an inch. The first segment 42 is also externally threaded along its length for engagement with the screw adjustor 24 as described below.

As shown in FIG. 2, a small aperture 50 is positioned in the sidewall of the first segment 42, and places the chamber 48 in communication with the outside environment. The aperture 50 is located at a small distance from the position of the deflector plate 38 within the pintle body 28. In the preferred embodiment, only one aperture 50 is disposed within the first segment 42. However, multiple apertures may be placed about the first segment if additional air is required to atomize the cleaning solvent as described more fully below.

As shown in FIG. 4, the extension 36 is integrally formed with the first segment 42 of the pintle body 28. A cylindrical chamber 52 having a diameter less than that of chamber 48 extends along the entire length of the extension 36 and through the pintle head 46. Near the midpoint of the extension 44, an annular notch 54 is defined in the extension. An O-ring 56 is placed within the notch 54 to facilitate a sealing engagement between the pintle body 28 and the housing 20. Also, a longitudinal groove 58 is located on the exterior surface of the extension 44 between the first segment 42 and the O-ring 56.

The pintle head 46 is positioned at the end of the extension 44. As mentioned above, the chamber 52 extends centrally through the end of the head 46. Typically, the head is of the same dimensions of the head of the IAC valve of the IAC System. As known to those of skill in the art, the heads of the IAC pintle valves are oftentimes tapered, and may consist of a first tapered portion and a second portion located near the tip that is tapered more significantly than the first portion.

Preferably, the pintle includes a separated inlet 26 and pintle body 28. In this embodiment, the pintle body 28 for the specific vehicle type may be exchanged to adapt the introduction device for different vehicles. Alternatively, the inlet 26 and the pintle body 28 can be formed integrally with one another.

As shown in FIG. 1, the housing 20 includes an upper housing 60 for the screw adjustor 24, a main body 62, an adaptor plate 64 for securing the introduction device 14 to the IAC mounting block 18 and an annulus 66 extending from the adaptor plate 64. As shown in FIG. 4, the first segment 42 and extension 44 of the pintle body 28 are disposed within a central bore 68 disposed longitudinal throughout the housing 20. The inlet 26 and pintle head 46 extending from either end of the housing. The housing is preferably machined from aluminum.

As shown in FIG. 4, the upper housing 60 is enclosed about the screw adjustor 24 on one side. About the remainder of the upper housing, the screw adjustor is accessible by the user. The inner diameter of the annular screw adjustor is threaded to match the threads of the adjustment segment of the rod, and the outer diameter is serrated. As further described below, as the screw adjustor is rotated, the pintle 22 moves relative to the housing 20.

The main body 62 of the housing is located between the upper housing 60 and the adaptor plate 64. A radial bore 69 extends through the main body from the outer surface of the body to the central chamber 52. The bore 69 is threaded to receive a small pin 70 having an end that is received within the longitudinal groove 58 of the pintle body 28. The pin 70 provides a stop to prevent the pintle 22 from disengaging the housing 20.

As shown in FIG. 1, the adaptor plate 54 of the housing contacts the plenum at the IAC mounting block 18. As known to those of ordinary skill in the art and described generally above, an IAC conduit 72 bypasses a throttle plate 74 of the air intake assembly of the vehicle. When the vehicle is in normal operation, the IAC System provides air through the IAC conduit 72 to the plenum to control the idle speed of vehicle. The IAC mounting block 18 provides access to the IAC conduit 72 via an IAC port 76. A seat 77 is formed in the IAC mounting block 28 at the IAC port 76. When the IAC System is attached to the vehicle, the head of the IAC valve is unseated to allow air through the space between the IAC valve head and the seat if the ECM determines that additional air is required to idle the vehicle at the desired RPM.

The adaptor plate 64 is secured to the IAC mounting block at a pair of threaded bores 78 and 80. These bores are employed to secure the IAC valve to the vehicle when the plenum is not being cleaned by the method and apparatus of the present invention. The adaptor plate has a pair of apertures 82 and 84 (FIG. 4) that are placed in alignment with bores 78 and 80, and a pair of mounting bolts 86 are placed through the apertures and the matching bores to secure the introduction device to the vehicle. The annulus 66 includes a first ring 88 and a second ring 90. When the housing 20 is bolted to the IAC mounting block 28, the outer diameter of the first ring 88 fits within the inner edge of the IAC port 76. The second ring 90 assists the user in centering the introduction device 10 prior to bolting the device to the vehicle.

A sealing gasket (not shown) is preferably placed between adaptor plate 64 and IAC mounting block 18 prior to installation. The gasket promotes a secure, airtight and liquid tight seal between the introduction device 10 and plenum of the vehicle. After the cleaning process is complete, the gasket will be used with the IAC system when the IAC pintle valve is remounted to the manifold.

There are currently at least five IAC mounting block configurations for use on commercially manufactured automobile engines. Thus, there are at least six current adaptor plates for use in connection with the present invention. Only one of the six adaptor plate configurations is shown. However, it is within the common experience and knowledge of those skilled in the art to construct and select the adaptor plate conforming to the IAC mounting block configuration of a particular engine. In one example, the annulus 66 may be threaded, and secured to a correspondingly threaded IAC port. In this embodiment, the adaptor plate is eliminate. Older vehicles manufactured by General Motors in the Chevrolet line require this type of connection. It is anticipated that other configurations will be used by manufacturers in the future and, thus, conforming adaptor plates and other mounting structures are within the scope of the present invention.

To use the apparatus of the present invention, the IAC pintle valve is removed from the IAC mounting block 18. As mentioned above, the IAC pintle valve is typically bolted to the mounting block 18 at the threaded bores 78 and 80. The appropriate introduction device 14 for the particular vehicle is selected to conform to the IAC mounting block 18 and the seat 77, and the device is bolted to the mounting block by placing bolts 86 through the apertures 82 and 84 of the mounting plate and into the block.

Solvent is placed within the supply tank, and the supply hose 12 is attached to the inlet 26 of the pintle 22. At this point, the valve on the supply tank is in the OFF position, and cleaning solvent is not allowed to flow through the hose 12. The pintle head 46 is placed against the seat 77 of the IAC mounting block. To place the pintle head 46 against the seat, the screw adjustor 24 is rotated in a first rotational direction. Since the threads of the screw adjustor 24 are in contact with the threads of the threaded cylindrical segment 42 of the pintle body 28, the pintle is translated relative to the housing 20 to an extended position as shown in FIG. 2 when the screw adjustor 24 is rotated. The depth of the seat 77 varies by make and model of vehicle, and the adjustable pintle height is required for the introduction device to adapt to various vehicles.

Once the pintle head 46 is placed against the seat 77, the vehicle engine is started. A small volume of air sufficient to allow the engine to be started is drawn into the aperture 50 of the pintle, through the chambers 38 and 52 and into the plenum. The engine of the vehicle may idle somewhat slower and faster than typical since the initially volume of air allowed through the device is not specifically controlled depending on the vehicle.

Figure 3:
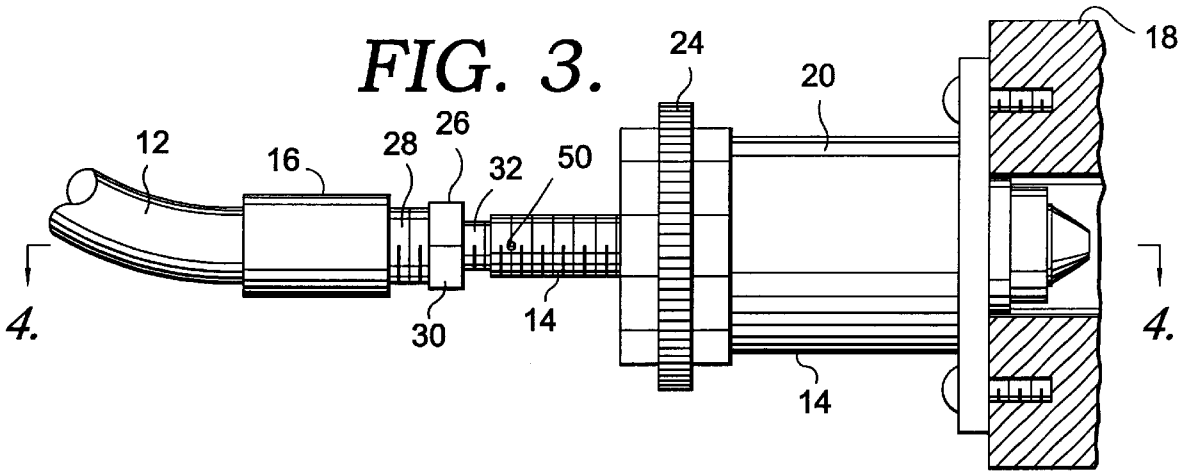
FIG. 3 is a view similar to FIG. 2, with the pintle head in a retracted position.

Next, the valve on the supply tank is slowly opened and cleaning solvent begins to flow through the supply hose 12 and into the inlet 26 of the introduction device 14. The cleaner is gravity fed and drawn by the slight vacuum within the plenum. If the idle speed of the vehicle begins to drop, the operator turns the screw adjustor 24 to allow more air into the plenum through the IAC conduit by moving the pintle to a more retracted position as shown in FIG. 3.

With reference to FIG. 4, the cleaner is first supplied to the chamber 36 of the inlet 26. As the cleaner accelerates through the orifice 40 and into the chamber 38, air is drawn through aperture 50 and a venturi effect is created in the chamber 38. The cleaning solvent is atomized into beads that are carried at high speed with the rush of incoming air from the aperture 50. The cleaning beads into the plenum near the backside of the throttle plate 74 and bombard the surfaces of the plenum with a sandblasting effect. In the preferred method, approximately eleven ounces of cleaner are dispensed into the plenum in about four minutes. This rate of introduction is particularly effective for cleaning the plenum, intake valves and combustion chambers.

The method and apparatus are safe, efficient and overcomes the problems associated with prior methods and devices. For instance, since the atomized beads are introduced near the throttle plate, the backside of the plate receives a thorough cleaning that was unlikely to be achieved by the methods using metering tips to introduce cleaner. Also, the throttle plate can be cleaned without opening the plate. In addition to cleaning the backside of the throttle plate, all of the runners of the plenum, floor and surrounding walls of the plenum, the invention removes deposits from around the EGR entrance port and Positive Crankcase Vent (PCV) port. The EGR port and PCV ports have been particular difficult to clean by previously available methods and devices.

By removing the IAC system and introducing the cleaner past the mass air flow and mass air pressure sensors, the operation of the vehicle's computers are not disrupted. Likewise, since the boot that connects the air filter box to the plenum does not have to be removed, the sensors and controls associated with the boot are unaffected. With the exception of a small amount of air that enters via the pintle valve, the vehicle's computers account for the volume of air that flows into the plenum.

Also, the IAC System is not harmed by the cleaning solvent since it is removed and replaced prior to the cleaning process. The method and device of this invention does not involve straws or spray tubes, and the amount of cleaner and idle speed are easily controlled by the user to avoid the problems of hydrolocking and creating an air flow that pulls the cleaner toward the center of the plenum. The risks of fire associated with aerosols in the open atmosphere are also avoided. The method and device are also advantageous because the effectiveness of the cleaning may be easily measured by taking the IAC counts with the computer scan tools commonly used by modem auto service centers. In other words, the condition of the plenum measured against the condition when new is measured in controlling the IAC system, and reading before and after the cleaning may be taking to demonstrate the benefits of the cleaning.

Figure 5:
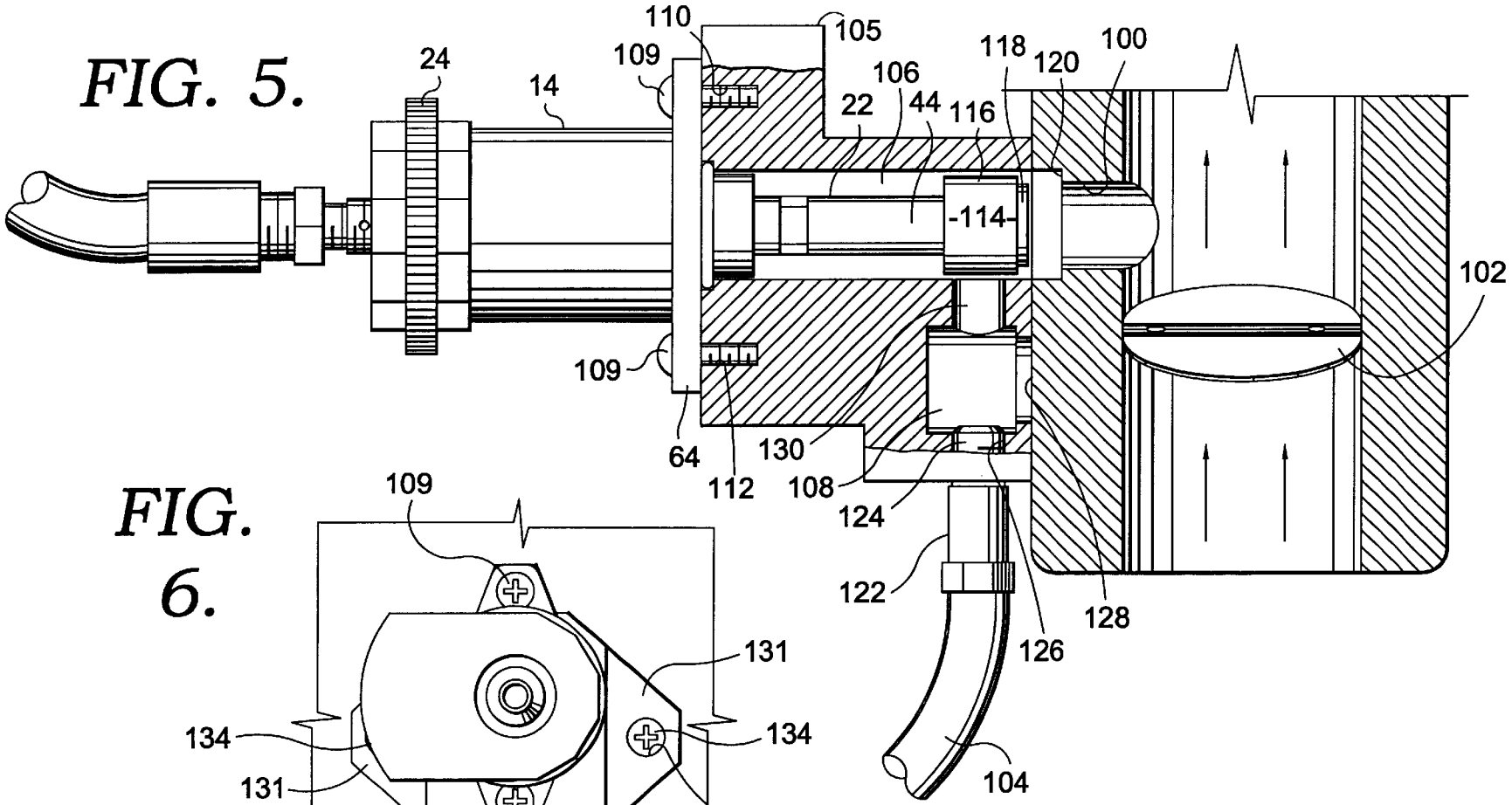
FIG. 5 is an elevational view of an alternative embodiment of the present invention, shown coupled to the IAC mounting block of a vehicle, with parts of the vehicle shown in section.
Figure 6:
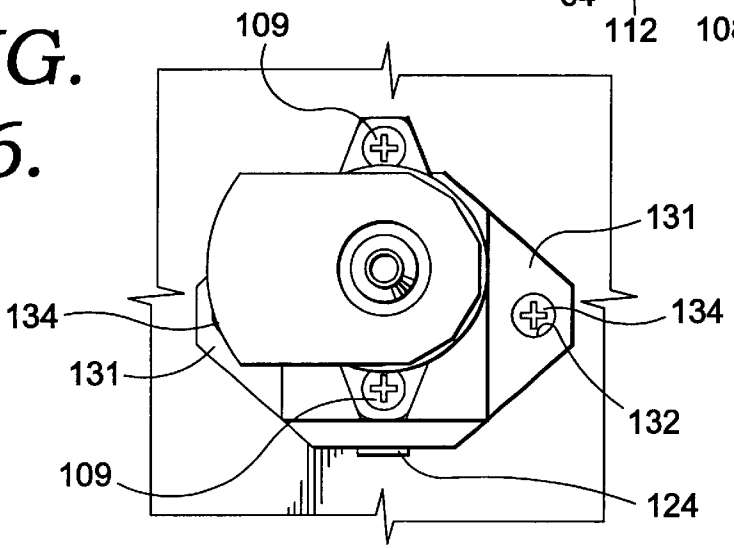
FIG. 6 is a plan view of the embodiment of the invention shown in FIG. 5.

An alternative embodiment is shown in FIGS. 5 and 6. In many vehicles such as many automobiles manufactured by the Ford Motor Company, an IAC conduit that bypasses the throttle plate is not employed to control the air provided to the plenum. As shown in FIG. 5, the IAC systems of these vehicles have an IAC port 100 located on the engine side of a throttle plate 102. As well known to those of skill in the art, the IAC system has an IAC hose 104 that pulls air from the boot that connects the air filter box to the plenum rather than an IAC bypass conduit. The mass air flow sensor in these vehicles measures the flow of air into the boot. Accordingly, it is important that the pulled from the boot by the IAC hose be introduced into the plenum during the cleaning process. Otherwise, the readings from the mass air flow sensor would not reflect the amount of air entering the plenum if the air pulled into the IAC hose is not provided to the plenum.

In these vehicles, an adaptor block 105 is employed to secure the introduction device 10 to the plenum of the vehicle. In a preferred embodiment, the adaptor block includes a first cavity 106 that is aligned with the IAC port 100, and a second cavity 106 the IAC hose 104 in communication with the first cavity. The introduction device 14 is secured to the adaptor block 105 by placing a pair of bolts 109 through the apertures (not shown) in the adaptor plate and into a pair of bores 110 and 112 in the adaptor block. When secured to the adaptor block, the extension 44 of the pintle 22 is disposed within the first cavity 106.

The introduction device 14 of FIG. 5 is the same as the device in FIGS. 1-4 except for the shape of the pintle head. A square headed pintle head 114 is shown that is identical in shape and size to typical IAC pintle heads of conventional IAC Systems. The head 114 is characterized by a cylindrical body 116 and an annulus 118 extending from the body. The pintle head 114 moves relative to a seat 120 defined within the adaptor block. In FIG. 5, the pintle head 114 is shown in a retracted position relative to the seat. Prior to starting the engine and administering the cleaning solvent through the introduction device 10, the pintle head is moved into contact with the seat by rotating the screw adjustor 24. When the square headed pintle is in contact with the seat 110, the annulus 118 is received within the IAC port 100 and the top of the cylindrical body 116 located about the annulus is in contact with the seat 110 so that excess air does not enter the plenum.

The IAC hose 104 stemming from the air boot (not shown) has a fitting 122 with a threaded outlet 124 that is received within a threaded inlet portion 126 of the second cavity 108. The second cavity 108 also has an opening 128 that is covered by the surface of the IAC mounting block when the adaptor block 105 is secured to the mounting block. A central passageway 130 of the second cavity 108 places air that flows through the IAC hose 104 in communication with the first cavity 106, and ultimately into the plenum during the introduction of solvent.

With reference to FIG. 6, the adaptor block 105 has an adaptor plate 131 extending in either direction from the walls of the block. The adaptor plate has a pair of apertures 132 that are placed in alignment with the bores (not shown) that are used to secure the IAC valve, and a pair of bolts 134 are employed to secure the adaptor block 105 to the IAC mounting plate.

The embodiment of FIGS. 5 and 6 operates similar to the embodiment described with reference to FIGS. 1–4 once the IAC System is removed, and the adaptor block 105 and introduction device 10 are secured to the vehicle. Briefly, the pintle head 116 is placed against the seat 120, and the vehicle is started. The supply tank is opened, and atomized cleaning solvent is supplied to the plenum through the IAC port 100. If additional air is needed to idle the vehicle during cleaning, the screw adjustor 24 is rotated so that the pintle head 116 is moved away from the seat. When this occurs, air is pulled from the air boot via the IAC hose 104 and is introduced into the plenum through the IAC port.

The preferred embodiment of the adaptor block is shown in FIGS. 5 and 6. However, the adaptor block may take any of a number of configurations to adapt to conform to the IAC mounting blocks of various makes and models of automobiles. Also, it is contemplated that the introduction device could be formed integrally with the mounting block rather than as a separate component that is secured to the mounting block during the cleaning process.

Although the invention has been described with reference to the preferred embodiments illustrated in the attached drawing figures, it is notes that substitutions may be made and equivalents employed herein without departing form the scope of the invention as recited in the claims.

The following is claimed:

1. A method for cleaning the plenum of a fuel injected combustion engine having an IAC system and an IAC port, comprising:

providing an introduction device adapted to conform to the IAC port on the combustion engine;

providing a solvent to the introduction device;

administering solvent to the plenum through the introduction device;

controlling the amount of air provided to the plenum during the step of administering the solvent, and terminating the administration of the solvent.

2. The method of claim 1, wherein the solvent is atomized prior to being administered at the IAC port.

3. A method for cleaning the plenum of a fuel injected combustion engine having an IAC system and IAC port, comprising:

providing an adaptor adapted to conform to the IAC port on the combustion engine;

providing an introduction device adapted to conform to the adaptor;

administering solvent to the plenum through the introduction device;

controlling the amount of air provided to the plenum during the step of administering the solvent, and terminating the administration of the solvent.

4. The method of claim 3, wherein the solvent is atomized prior to being introduced at the IAC port.

5. The method of claim 4, further comprising the step of connecting an IAC hose to the adaptor.

* * * * *